US007243918B2

(12) United States Patent
Vernon

(10) Patent No.: US 7,243,918 B2
(45) Date of Patent: Jul. 17, 2007

(54) EXTENSION FOR ROTATABLE PUZZLE PIECE

(76) Inventor: Robert D Vernon, PMB 220 2525 Arapahoe Ave., E4, Boulder, CO (US) 80302-6720

( * ) Notice: Subject to any disclaimer, the term of this patent is extended or adjusted under 35 U.S.C. 154(b) by 314 days.

(21) Appl. No.: 10/859,970

(22) Filed: Jun. 4, 2004

(65) Prior Publication Data

US 2004/0245721 A1 Dec. 9, 2004

(51) Int. Cl.
*A63F 9/08* (2006.01)

(52) U.S. Cl. ..... 273/153 S

(58) Field of Classification Search ..... 273/153 S, 273/153 R, 157 R

See application file for complete search history.

(56) References Cited

U.S. PATENT DOCUMENTS

| | | | | | |
|---|---|---|---|---|---|
| 448,019 | A | * | 3/1891 | Garben | 273/153 S |
| 631,737 | A | * | 8/1899 | Compton et al. | 273/153 S |
| 814,653 | A | * | 3/1906 | Healey | 273/153 S |
| 1,101,567 | A | * | 6/1914 | Ridgway | 273/153 S |
| 1,132,430 | A | * | 3/1915 | Brogan et al. | 273/153 S |
| 1,459,937 | A | * | 6/1923 | Teipel | 273/153 S |
| 1,477,371 | A | * | 12/1923 | Larabee | 273/153 S |
| 3,148,884 | A | * | 9/1964 | Steinhardt | 273/153 S |
| 3,946,514 | A | * | 3/1976 | Joslyn | 273/153 S |
| 4,269,414 | A | * | 5/1981 | DeVos et al. | 273/153 S |
| 4,412,681 | A | * | 11/1983 | Irwin | 273/153 S |
| 4,422,641 | A | | 12/1983 | Collin | |
| 4,486,017 | A | * | 12/1984 | Evert, Jr. | 273/153 S |
| 4,513,970 | A | | 4/1985 | Opresco et al. | |
| 4,524,971 | A | * | 6/1985 | Sasso | 273/153 S |
| 4,548,410 | A | | 10/1985 | Morrone | |
| 5,074,561 | A | | 12/1991 | Johnson | |
| 5,267,732 | A | | 12/1993 | Bowen et al. | |
| 5,529,301 | A | | 6/1996 | Feller | |
| 5,622,368 | A | * | 4/1997 | Chang | 273/153 S |
| D380,241 | S | | 6/1997 | Caron | |
| 5,785,318 | A | | 7/1998 | Nesis | |
| 5,947,473 | A | * | 9/1999 | Spitzer | 273/153 S |
| 6,116,600 | A | | 9/2000 | Aryan | |

* cited by examiner

*Primary Examiner*—Steven Wong
(74) *Attorney, Agent, or Firm*—The Harris Firm

(57) ABSTRACT

An extension for a rotatable puzzle piece that is used with a sliding puzzle, and a sliding puzzle that uses the same. In one aspect the puzzle has an extension for a rotatable puzzle piece, comprising a housing including a backing frame and a front member connected one to the other. The backing frame is formed with a fixedly disposed first recess defined by walls formed on the backing frame. A fixedly disposed second recess is defined by the front member. The puzzle also includes a plurality of puzzle pieces disposed in the second recess, wherein each of the pieces is individually slidably movable in the second recess, whereby the pieces are movable so as to be arranged in a desired solution in the second recess. A channel operatively communicates with the second recess such that the pieces can be moved into the channel and rotated therein, thereby rotationally reorienting the pieces. The rotationally reoriented pieces can be moved into the second recess in an attempt to solve the puzzle.

9 Claims, 7 Drawing Sheets

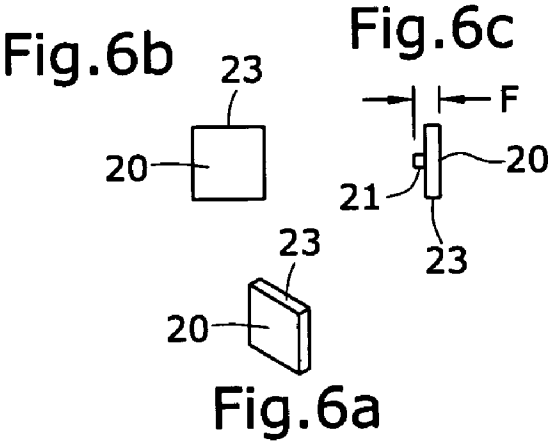
Fig.6c
F
20
23
21
Fig.6b
23
20
23
20
Fig.6a
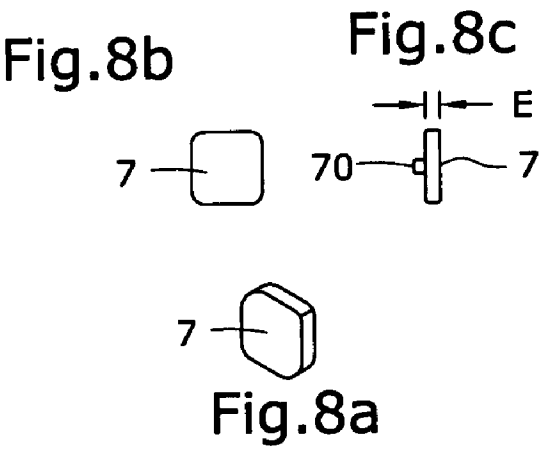
Fig.8c
E
7
70
Fig.8b
7
7
Fig.8a
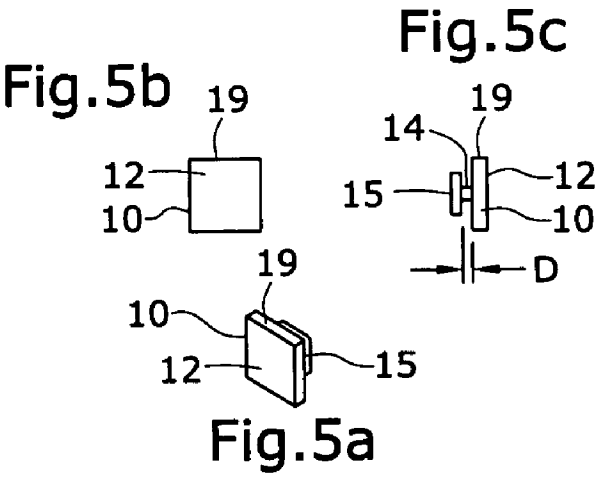
Fig.5c
19
12
10
D
14
15
Fig.5b
19
12
10
19
15
10
12
Fig.5a
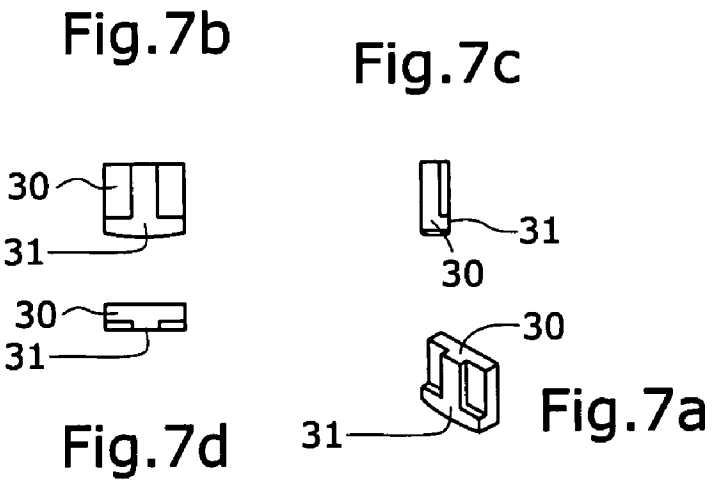
Fig.7c
31
30
30
Fig.7a
31
Fig.7b
30
31
30
31
Fig.7d

EXTENSION FOR ROTATABLE PUZZLE PIECE

FIELD OF THE INVENTION

The present invention relates to an extension for a rotatable puzzle piece that is used with a sliding puzzle.

BACKGROUND OF THE INVENTION

Several limitations are found in existing sliding puzzles, particularly puzzles composed of images, and not just letters or numbers. Puzzle pieces bearing just letters or numbers can be effectively scrambled simply by altering their order in relation to one another. In cases where assembled puzzle pieces reveal a single image, however, scrambling of the image is further enhanced if the pieces are also disoriented (i.e., turned sideways or upside down).

U.S. Pat. No. 4,548,410 discloses a number puzzle that has an exterior frame and an interior frame that house sliding, numbered, puzzle tiles. None of the tiles can be rotationally disoriented, however.

U.S. Pat. No. 5,529,301 discloses a slide puzzle that has a frame in which are mounted rectangular sliding pieces that fit together and slide past one another according to corresponding strips and grooves. None of the pieces can be rotationally disoriented, however.

U.S. Pat. No. 4,412,681 discloses a two dimensional logical toy that has parallel and transverse grooves for sliding unitary elements, and a rotatable lift. None of the elements can be individually rotationally disoriented, however.

Hence, the prior art fails to provide a sliding puzzle where puzzle pieces can be individually scrambled and disoriented.

SUMMARY OF THE INVENTION

Thus, the present invention provides a puzzle with pieces that can be individually scrambled and disoriented.

One aspect of the present invention is directed to an extension for a rotatable puzzle piece that includes an extension that is operatively part of a sliding puzzle wherein the puzzle incorporates vertically or horizontally oriented channels in which pieces are permitted to slide to extend beyond a main boundary of the puzzle, thereby allowing the puzzle piece to be rotated in the extension.

In another aspect, when the extension allows a puzzle piece to slide outside the main puzzle boundary, the puzzle piece may then be freely rotated allowing the piece to reenter the main puzzle boundary such that its original orientation has been altered in ninety degree increments.

In yet another aspect, the sliding puzzle has a vertical and/or horizontal extension outside a shape of the puzzle, and puzzle pieces have the ability to rotate on their axes when moved into the extension.

In still another aspect, the puzzle pieces individually rotate in the extension.

In still another aspect, the main boundary is rectangular.

A second aspect of the present invention is directed to a slidable puzzle, comprising a puzzle having a main puzzle boundary and shape, and an extension that operatively receives at least one rotating puzzle piece, wherein the piece rotates in the extension.

In another aspect, the puzzle is a handheld puzzle that incorporates vertically or horizontally oriented channels in which the at least one puzzle piece is permitted to slide to extend beyond rectangular boundaries of the puzzle allowing the puzzle pieces to be rotated.

In yet another aspect, when the extension allows a puzzle piece to slide outside the main puzzle boundary, the at least one puzzle piece may then be freely rotated, thereby allowing it to reenter the main puzzle boundary such that its original orientation has been altered in a ninety degree increment.

In still another aspect, the extension for the at least one rotatable puzzle piece is outside the shape of the puzzle, the at least one puzzle pieces having the ability to rotate on their axes when moved into the extension.

A third aspect of the of present invention is directed to a puzzle having an extension for a rotatable puzzle piece, comprising a housing including a backing frame and a front member connected one to the other. The backing frame is formed with a fixedly disposed first recess defined by walls formed on the backing frame. A fixedly disposed second recess is defined by the front member. The puzzle also includes a plurality of puzzle pieces disposed in the second recess, wherein each of the pieces is individually slidably movable in the second recess, whereby the pieces are movable so as to be arranged in a desired solution in the second recess. A channel operatively communicates with the second recess such that the pieces can be moved into the channel and rotated therein, thereby rotationally reorienting the pieces. The rotationally reoriented pieces can be moved into the second recess in an attempt to solve the puzzle.

In another aspect, the channel is defined by the front member.

In still another aspect, the channel is also defined by the backing frame.

In yet another aspect, the channel is detachable from the puzzle.

In still another aspect, the puzzle is handheld.

In yet another aspect, the puzzle further includes an end member.

In still another aspect, the end member is detachably connected to close an open end of the channel.

In yet another aspect, the puzzle includes a locking piece.

In still another aspect, the locking piece prevents puzzle pieces from moving when it is used.

In yet another aspect, the puzzle pieces have faces that collectively form an image, the recreation of which solves the puzzle.

BRIEF DESCRIPTION OF THE DRAWINGS

In the accompanying drawings, which form a part of the specification and are to be read in conjunction therewith, and in which like reference numerals are used to indicate like parts in the various views:

FIG. 5*a* is a perspective view of the puzzle piece of FIG. 1;

FIG. 5*b* is a front plan view of the puzzle piece of FIG. 1;

FIG. 5*c* is a side plan view of the puzzle piece of FIG. 1;

FIG. 6*a* is a perspective view of the locking piece of FIG. 1;

FIG. 6*b* is a front plan view of the locking piece of FIG. 1;

FIG. 6*c* is a side plan view of the locking piece of FIG. 1;

FIG. 7*a* is a perspective view of the end member of FIG. 1;

FIG. 7*b* is a front plan view of the end member of FIG. 1;

FIG. 7*c* is a left side plan view of the end member of FIG. 1;

FIG. 7*d* is a top plan view of the end member of FIG. 1;

FIG. 8*a* is a perspective view of a guide piece of FIG. 1;

FIG. 8*b* is a front plan view of a guide piece of FIG. 1;

FIG. 8*c* is a side plan view of a guide piece of FIG. 1;

DETAILED DESCRIPTION OF THE INVENTION

As illustrated in the accompanying drawings and discussed in detail below, one aspect of the present invention is directed to an extension for a rotatable puzzle piece. The present invention is thus intended to address the inherent limitations in existing sliding puzzles, particularly sliding puzzles composed of images as opposed to letters or numbers. Puzzle pieces bearing a letter or number in a standard sliding puzzle can be effectively scrambled simply by altering their order. However, where the puzzle pieces reveal a single image when properly assembled, scrambling of the image is significantly enhanced by being able to present pieces out of order and out of orientation (i.e., upside down and backwards). The present invention permits such effective scrambling and disorientation, thus providing a significantly more challenging puzzle to the user.

Figure 2:
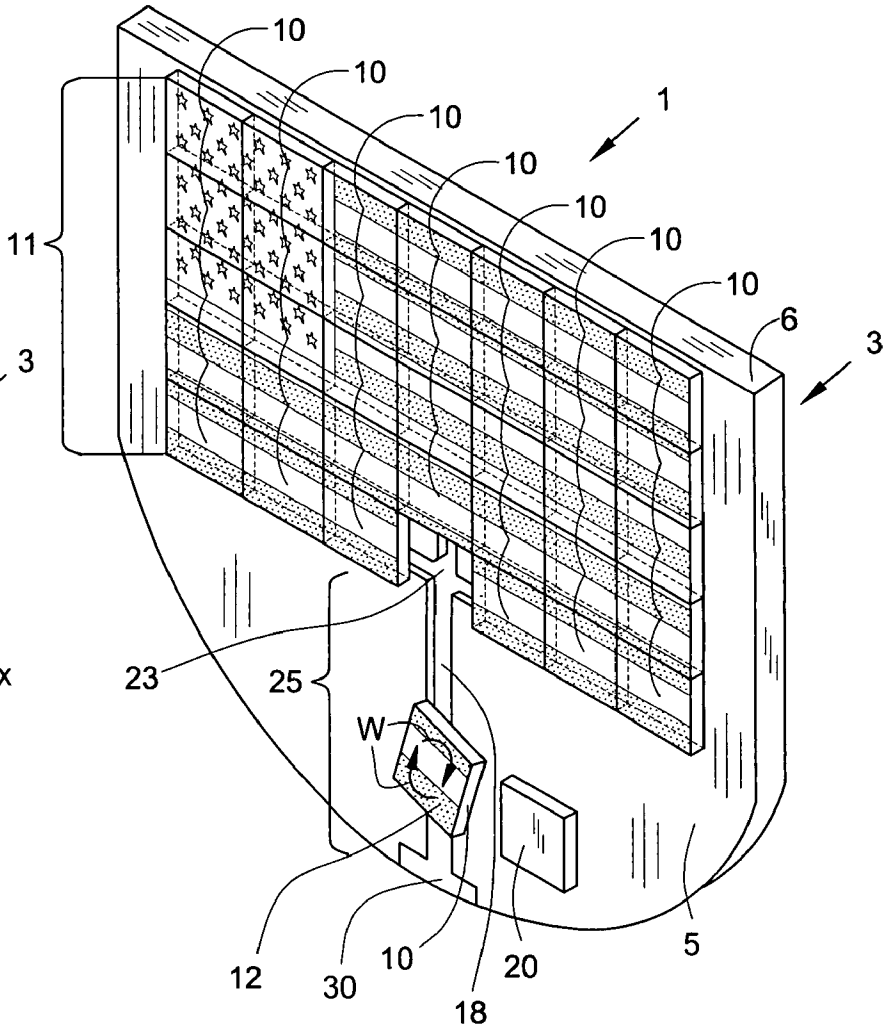
FIG. 2 is a perspective view of the puzzle of FIG. 1 with all of its puzzle pieces, including one piece in an extension for its rotation.
Figure 1:
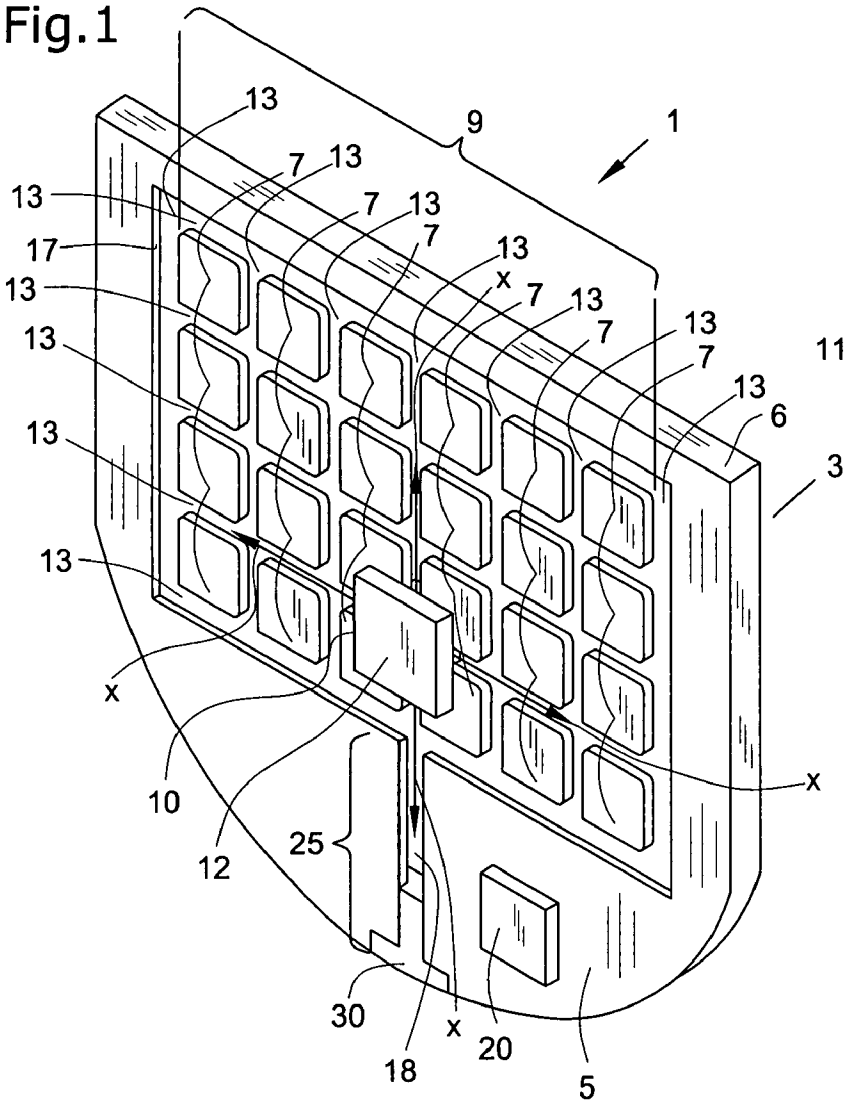
FIG. 1 is a perspective view of a puzzle according to the present invention that has one puzzle piece.

The puzzle extension of this aspect can be formed as part of, or attached to, any sliding puzzle. Referring more particularly to FIGS. 1 and 2, puzzle 1 includes 5×7 array 11 of individual puzzle image pieces 10, 4×6 array 9 of guide members 7, backing frame 3, front plate 5, locking piece 20, and end member 30.

Individual puzzle piece 10 has a portion of a complete puzzle image on its face 12, which can be moved as piece 10 is moved any where along vertical and horizontal grooves 13. Grooves 13 make up a latticework recess of transversely oriented intersecting channels. As shown in FIG. 1, piece 10 can be moved in the immediate directions indicated by arrows X. Thus, movement of pieces 10 in FIG. 2 includes both horizontal and vertical movements that effectively "move" the positioning of free space 23. Nevertheless, any directional movement of pieces, including but not limited to, linear, curvilinear, diagonal, horizontal, vertical or other movements and/or combinations thereof suitable for use in a puzzle, may be used.

Individual piece 10 can also be moved into groove 18 of extension 25 so that it can be rotated 90 degrees, 180 degrees, or 270 degrees before it is moved out of groove 18 and back into the image contained within the main puzzle boundary. Piece 10 can be operatively rotated either counterclockwise or clockwise, as shown by direction arrows W.

Between movements into and out of groove 18, space 23, which is initially occupied by piece 10, can be occupied by other pieces 10 in order to scramble these pieces with respect to one another. Any of pieces 10 can therefore be moved into groove 18, rotated, and returned to the image.

The main boundary is roughly defined by window surface 17, but puzzles formed in many shapes and configurations or having any suitable matrix of image pieces can be used. For example, puzzles suitable for use with this invention include, but are not limited to, puzzles having circular, rectangular, triangular, linear, oval, wavy, tapered, irregular, trapezoidal, amorphous, or other shaped main boundaries.

Locking piece 20 is conveniently positioned in hole 15 during play, and inserted into groove 18 to lock all of pieces 10 into place as desired, e.g., when not in use. Locking piece 20 is sized to fill groove 18 and prevent pieces 10 from moving. A suitable locking piece can be in many sizes, shapes or configurations, as long as it prevents puzzle image pieces from moving when used.

Figure 4:
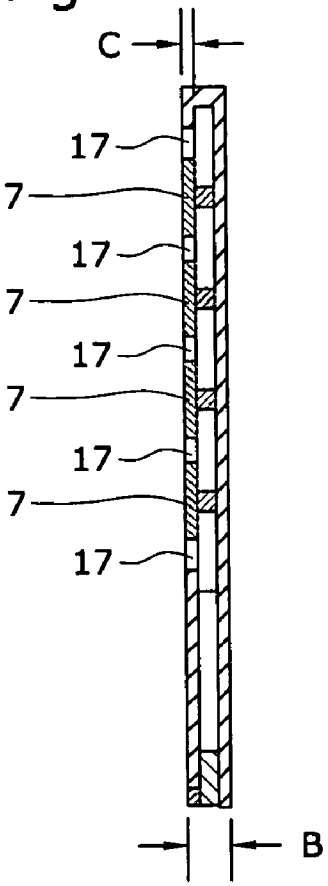
FIG. 4 is a cross-sectional side view of the puzzle in FIG. 3, along line A-A.
Figure 3:
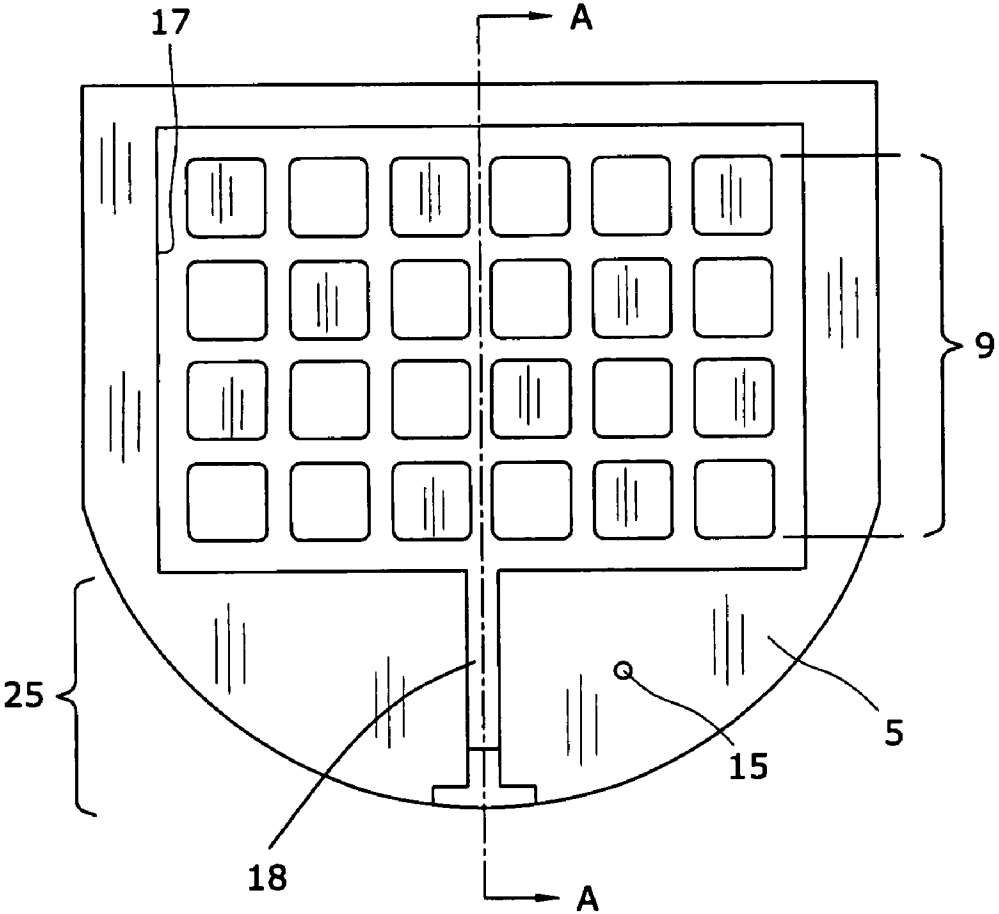
FIG. 3 is a front plan view of the puzzle of FIG. 1, without its puzzle piece or locking piece.
Figure 4A:
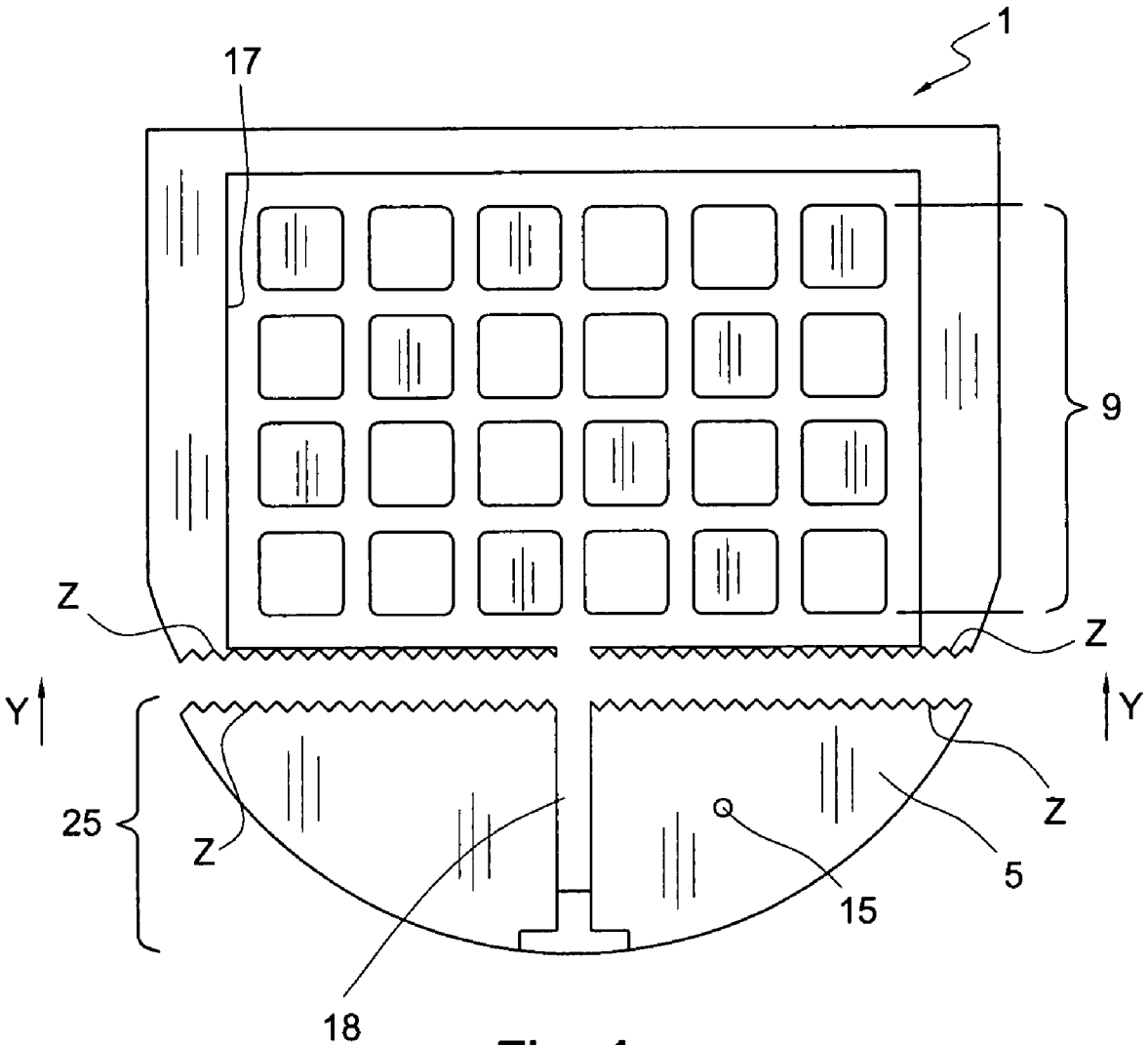
FIG. 4*a* is a front plan view of the puzzle of FIG. 1, but with an attachable extension.

Puzzle 1 is handheld, lightweight, and easy to construct. Referring to FIGS. 3 and 4, puzzle 1 has a thickness B, and plate 5, including inner window side surface 17, has a thickness C. Extension 25 is formed as an integrated, monolithic part of puzzle 1. In particular, groove 18 is defined by plate 5, backing 3, and end piece 30. Referring to FIG. 4*a*, extension 25 can alternately be separately formed and attached to puzzle 1 at interfaces Z as shown by direction arrows Y, however, as is suitable to provide individual rotation of puzzle pieces.

Referring to FIGS. 5*a-c*, each puzzle piece 10 has top section 19 with front face 12, cylindrical middle section 14, and foot 15. Middle section 14 is centrally disposed on the back of top section 19 and the top of foot 15. The distance between top section 19 and foot 15 is D.

Referring to FIGS. 6*a-c*, locking piece 20 has cylindrical foot 21, which is centrally disposed onto the back of top section 23. Top section 23 is the same size, and has the same dimensions, as top section 19 of puzzle pieces 10. The height of locking piece 20 is F, which is roughly equal to the combined width of top section 19 and middle section 14 of piece 10.

Referring to FIGS. 7*a-d*, end member 30 has raised T-shaped portion 31, which snuggly fits into, and closes an open end of, groove 18. In one embodiment, end piece 30 is removable, so that multiple puzzle pieces 10 can be removed by the user to enable a quick solution to puzzle 1.

Referring to FIGS. 8*a-c*, guide member 7 has top section 70 that has a width E. So that guide members 7 provide optimal guidance for sliding pieces 10, width D between top section 19 and foot 15 of puzzle piece 10 is approximately equal to, or slightly greater than, width E of top section 70 and width C of side window surface 17. Top 70 of guide member 7 is also approximately level with side window surface 17. Any relative dimensions suitable for allowing pieces 10 to easily slide between guide members 20 can be used as well, however.

In an alternate embodiment, interconnecting strips and grooves such as those disclosed in U.S. Pat. No. 5,529,301, which is hereby incorporated by reference in its entirety, can be used in lieu of guide members 20 and pieces 10. However, any sliding puzzle piece arrangement suitable to hold image pieces in place and allow them to be rotationally reoriented and scrambled with respect to one another during ordinary use can be used.

Figure 9:
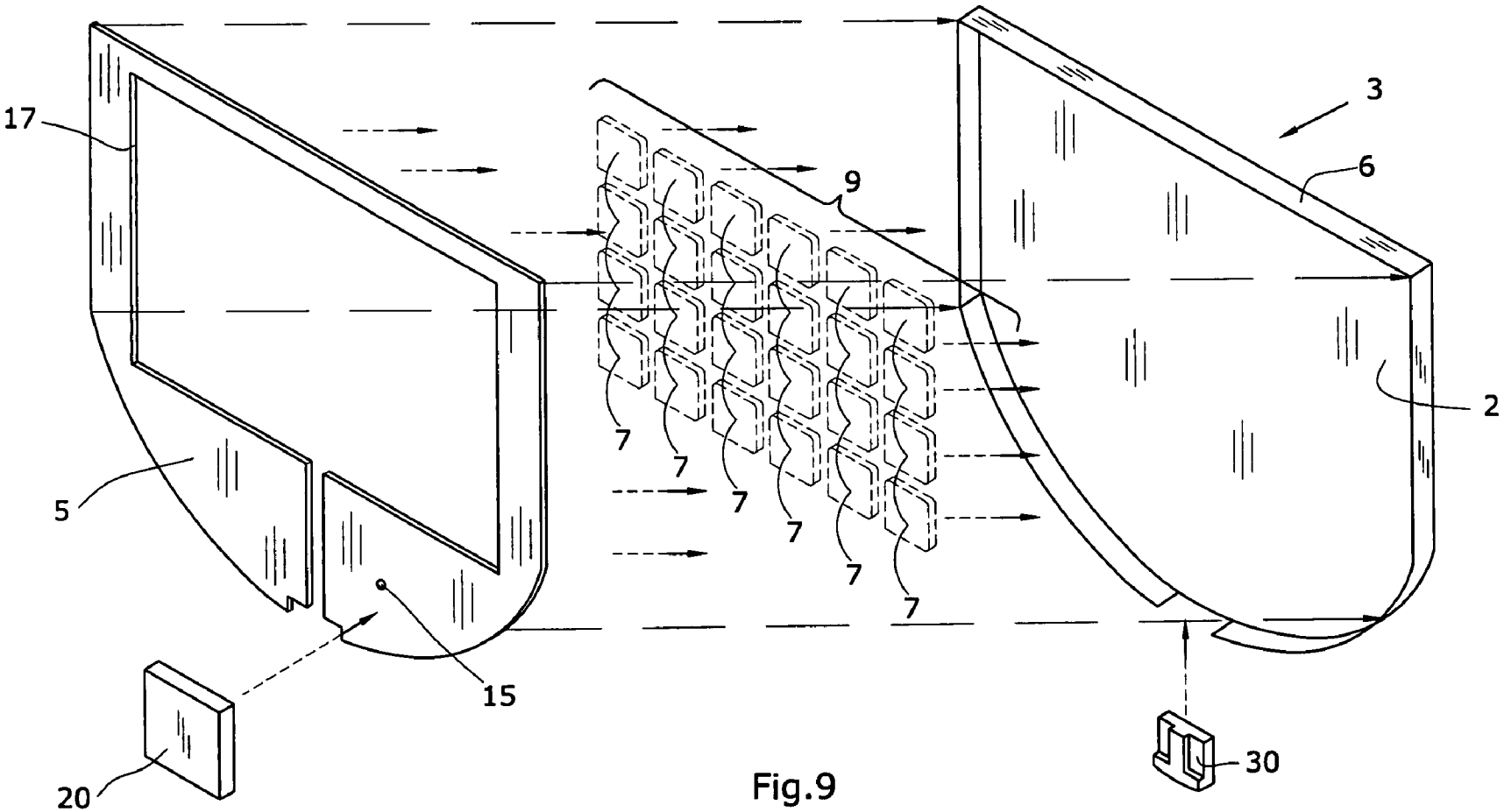
FIG. 9 is an assembly view of the puzzle in FIG. 2, without its puzzle pieces.

Referring to FIG. 9, array 9 of guide members 7 are attached to inner surface 2 of backing frame 3. Plate 5 is securely attached to sides 6 of backing frame 3 by an adhesive. Locking piece 20 removably fits into hole 15 by its foot 21 (not shown). Array 11 of puzzle pieces 10 (not shown in this FIG.) slide into groove 18 so that they fill window 17. End member 30 fits into groove 18 between plate 5 and backing frame 3.

Puzzle 1, extension 25, and their respective component parts can be made of any material suitable for making sliding puzzles such as various plastics, wood, or metals.

Figure 10:
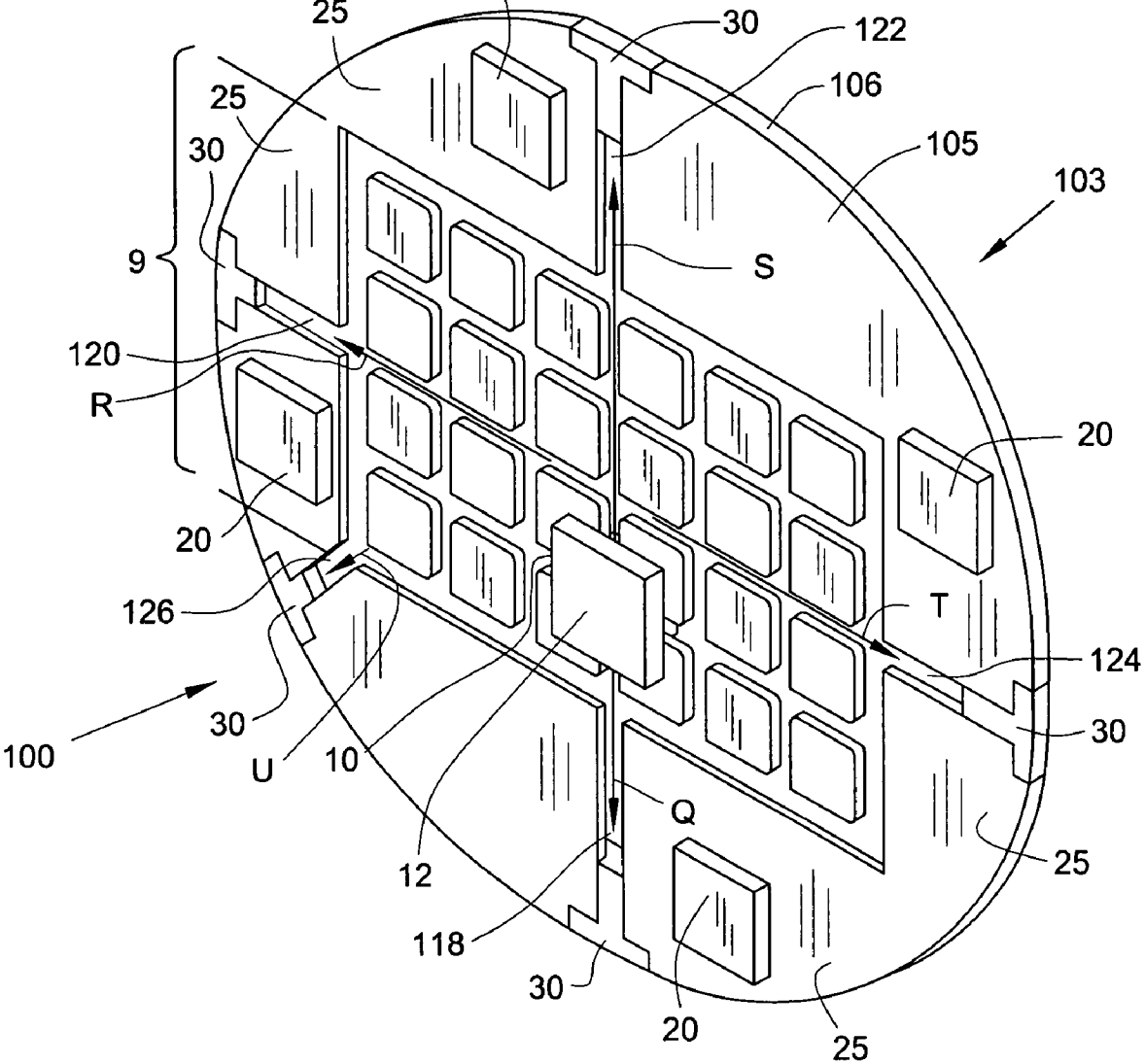
FIG. 10 is an alternate embodiment of a puzzle according to the present invention that has one puzzle piece and multiple puzzle extensions, including a diagonally oriented extension.

In an alternate embodiment, multiple puzzle extensions 25 are used to vary the degree of puzzle solution difficulty, and/or allow simultaneous access to multiple users. Referring to FIG. 10, front plate 105 and backing member 103, which has sides 106, house extensions 25 on four sides of puzzle 100. Thus, pieces 10 can move into grooves 118, 120, 122, 124, and 126, according to respective direction arrows Q, R, S, T, and U.

A second aspect of the present invention is directed to a puzzle having an extension for a rotatable puzzle piece, some of the elements of which are substantially described above.

In one embodiment, this aspect is directed to a handheld puzzle having an extension for a rotatable puzzle piece that includes a housing. The housing includes a backing frame and a front member connected one to the other. The backing frame is formed with a fixedly disposed first recess defined by walls formed on the backing frame. A fixedly disposed second recess is defined by the front member.

A plurality of puzzle pieces are disposed in the second recess, and each of the pieces are individually slidably movable in the second recess such that the pieces are movable so as to be arranged in a desired solution in the second recess. The puzzle pieces have faces that collectively form an image, the recreation of which solves the puzzle.

Figure 11:
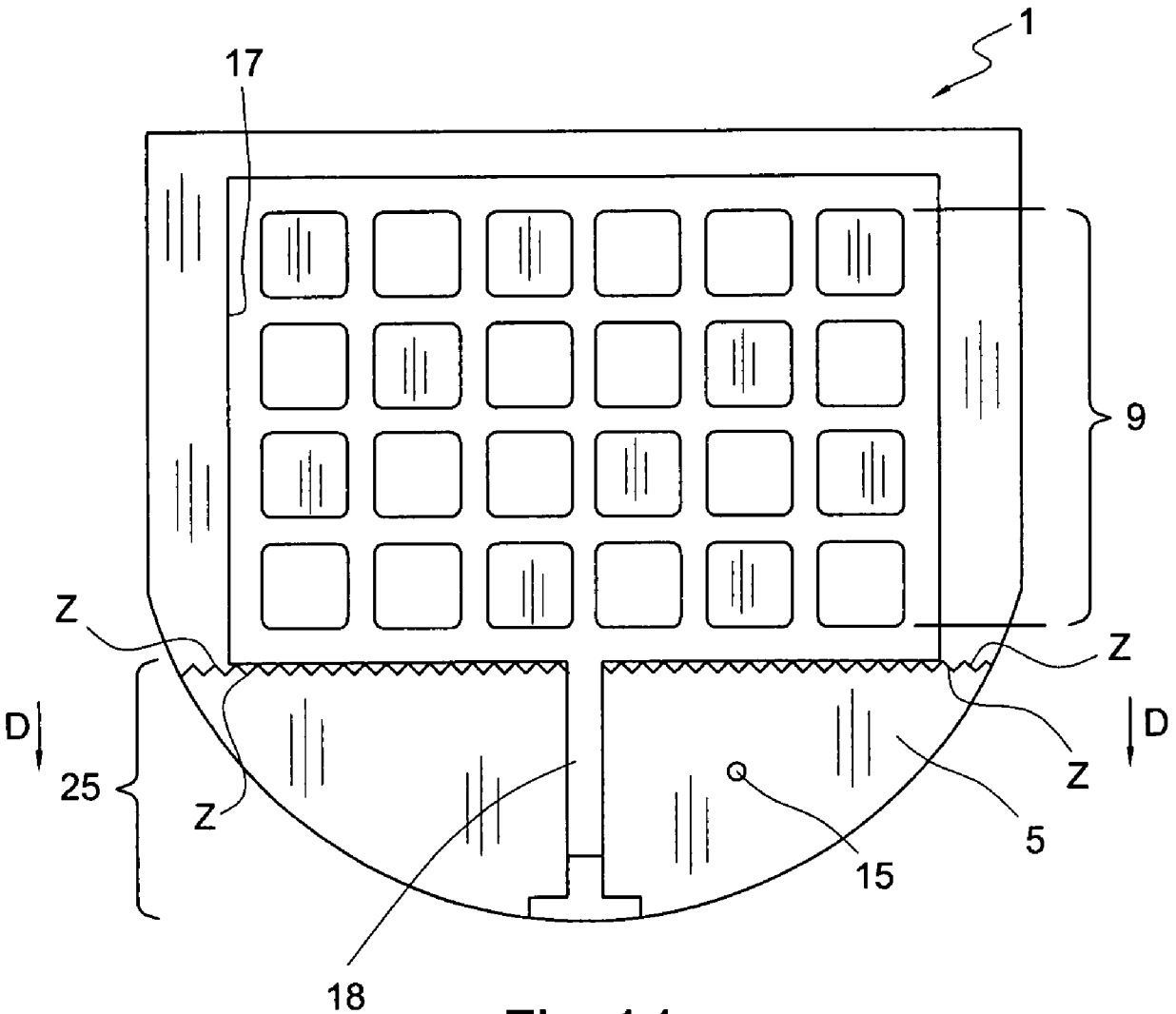
FIG. 11 is a front plan view of the puzzle of FIG. 1, but with a detachable extension.

Referring to FIG. 11, a detachable channel operatively communicates with the second recess such that the pieces can be moved into the channel and rotated therein, thereby rotationally reorienting the pieces. The rotationally reoriented pieces can be moved into the second recess in an attempt to solve the puzzle. The channel is defined by the front member. The channel is also defined by the backing frame.

The puzzle further includes an end member that is detachably connected to the extension to close an open end of the channel. The puzzle also includes a locking piece that prevents puzzle pieces from moving when used.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments that would come within the spirit and scope of the present invention.

I claim:

1. A puzzle having an extension for a rotatable puzzle piece, comprising:

a housing including a backing frame and a front member connected one to the other;

the backing frame being formed with a fixedly disposed first recess defined by walls formed on the backing frame into which first recess a plurality of guide members are individually attached as an immobile guide member array, and a fixedly disposed second recess, an external boundary of which is defined by the front member, and an internal portion of which is defined by the guide member array;

a plurality of puzzle pieces disposed in the second recess, each of the pieces being individually slidably movable in the second recess, but not rotatably movable when substantially all the pieces are disposed therein, whereby the pieces are movable so as to be arranged in a desired solution in the second recess; and a channel that operatively communicates with the second recess such that the pieces can be moved outside of the external boundary of the second recess into the channel and rotated therein, thereby rotationally reorienting the pieces;

wherein the rotationally reoriented pieces can be moved into the second recess in an attempt to solve the puzzle.

2. The puzzle of claim 1 wherein the channel is defined by the front member, and the second recess is a latticework recess.

3. The puzzle of claim 2 wherein the channel is also defined by the backing frame, and the external boundary of the latticework recess and the array of pieces each have a respective shape;

wherein the shape of the external boundary of the latticework recess is approximately the same as the shape of the array of pieces.

4. The puzzle of claim 1 wherein the channel is operatively attachable to or detachable from the puzzle.

5. The puzzle of claim 1 wherein the puzzle can be handheld; the guide members are equilateral in shape; and the puzzle is subsequently solved by correctly re-positioning the reoriented pieces by transversely sliding them across the guide member array.

6. The puzzle of claim 1 further comprising an end member that is detachably connected to close an open end of the channel.

7. The puzzle of claim 5 further comprising a locking piece that prevents puzzle pieces from moving when it is used.

8. The puzzle of claim 6 wherein the puzzle pieces have faces that collectively form an image, the recreation of which solves the puzzle.

9. A slidable puzzle, comprising:

a puzzle configured as a planar array of immediately adjacent pieces that slide transversely, both horizontally and vertically, across a latticework recess, which scrambles or correctly re-positions the pieces;

a puzzle housing that supports the array;

wherein the housing includes a backing frame and a front member connected one to the other;

the backing frame is formed with a fixedly disposed first recess defined by walls formed on the backing frame into which recess a plurality of square guide members are individually attached as an immobile guide member array;

the latticework recess is formed by the guide member array, an external boundary of such recess being defined by the front member, and what remains of the latticework recess being defined by the guide member array;

the external boundary of the latticework recess and the planar array of pieces each have a respective perimeter shape, and the shape of the external boundary of the latticework recess is approximately the same as the shape of the array of pieces;

the planar array of puzzle pieces disposed in the latticework recess, each of the pieces being individually, slidably movable in therein, but not rotatably movable when substantially all the pieces are disposed therein, whereby the pieces are movable so as to be arranged in a desired solution in the latticework recess; and an extension that operatively receives at least one rotating puzzle piece outside of the array;

wherein the piece rotates in the extension, but cannot rotate within the array when immediately side-by-side another piece in the array; and wherein the puzzle can be solved only by first reorienting a piece in the extension and then transversely repositioning it, in at least two transverse directions, inside the array;

the extension for the at least one rotatable puzzle piece is outside the shape of the puzzle, the at least one puzzle piece having the ability to rotate on its axes when moved into the extension;

the puzzle has a single, horizontal, vertical, or diagonal extension; and the extension comprises a channel that operatively communicates with the latticework recess such that the pieces can be moved outside of the external boundary of the latticework recess into the channel and rotated therein, thereby rotationally reorienting the pieces;

wherein the rotationally reoriented pieces can be moved into the latticework recess in an attempt to solve the puzzle.

* * * * *